United States Patent [19]

Le Creurer et al.

[11] Patent Number: 4,622,941

[45] Date of Patent: Nov. 18, 1986

[54] CYLINDER-HEAD UNIT FOR AN INTERNAL COMBUSTION ENGINE HAVING THREE VALVES

[75] Inventors: Maurice Le Creurer, Taverny; Joseph Behar, Bezons, both of France

[73] Assignees: Automobiles Peugeot, Paris; Automobiles Citroen, Neuilly-sur-Seine, both of France

[21] Appl. No.: 715,468

[22] Filed: Mar. 25, 1985

[30] Foreign Application Priority Data

Mar. 27, 1984 [FR] France ..... 84 04761

[51] Int. Cl.[4] ..... F02B 15/00

[52] U.S. Cl. ..... 123/432; 123/90.27; 123/193 H

[58] Field of Search ..... 123/193 R, 193 H, 306, 123/308, 432, 90.27

[56] References Cited

U.S. PATENT DOCUMENTS

| | | | |
|---|---|---|---|
| 1,915,237 | 6/1933 | Moore | 123/432 |
| 2,380,066 | 7/1945 | Pescara | 123/52 M |
| 3,429,303 | 2/1969 | Roberts | 123/59 R |
| 3,531,234 | 9/1970 | Ravenel | 123/193 H |
| 3,556,060 | 1/1971 | Henry-Biabaud | 123/432 |

FOREIGN PATENT DOCUMENTS

| | | | |
|---|---|---|---|
| 0062143 | 10/1982 | European Pat. Off. . | |
| 100790 | 2/1984 | European Pat. Off. . | |
| 113450 | 7/1984 | European Pat. Off. | 123/308 |
| 473371 | 3/1929 | Fed. Rep. of Germany . | |
| 1258655 | 1/1968 | Fed. Rep. of Germany | 123/193 H |
| 2815701 | 10/1979 | Fed. Rep. of Germany | 123/432 |
| 406699 | 12/1943 | Italy | 123/193 H |
| 423037 | 7/1947 | Italy | 123/432 |

*Primary Examiner*—Craig R. Feinberg

*Attorney, Agent, or Firm*—Burns, Doane, Swecker & Mathis

[57] ABSTRACT

The two inlet pipes and the exhaust pipe (6) open onto the same lateral wall (7) of the cylinder-head, the exhaust pipe opening onto this lateral wall at a level between the level of the inlet pipes and the level of the surface of the cylinder-head in contact with the cylinder-block (2). The other side (8) of the cylinder-head is in this way free to receive a precombustion chamber (9) and the timing gear can be constructed with a single overhead cam-shaft (12).

3 Claims, 6 Drawing Figures

CYLINDER-HEAD UNIT FOR AN INTERNAL COMBUSTION ENGINE HAVING THREE VALVES

FIELD OF THE INVENTION

The invention relates to an internal combustion engine comprising three valves per cylinder, namely two inlet valves and an exhaust valve. It is known that this arrangement is of particular interest in the case of compression-ignited engines.

In an arrangement already proposed for such an engine (EP-A-No. 0062143), the inlet pipes, on one hand, and the exhaust pipes, on the other hand, open onto opposed lateral sides of the cylinder-head, which does not permit the placement of a precombustion chamber under ideal conditions, owing to the lack of available place.

SUMMARY OF THE INVENTION

An object of the invention is to overcome this drawback and to facilitate moreover the arrangement of the timing gear by means of a single overhead cam shaft for all of the valves.

The invention therefore concerns a cylinder-head unit of an internal combustion engine having a plurality of cylinders whose axes are contained in a longitudinal plane, each cylinder comprising two inlet valves each cooperating with an inlet pipe and an exhaust valve cooperating with an exhaust pipe, the inlet pipes being disposed symmetrically with each other relative to a diametral plane of the cylinder containing the mean line of the exhaust pipe, said diametral plane being perpendicular to said longitudinal plane.

According to the invention, this cylinder-head unit is so arranged that the inlet pipes and the exhaust pipe open onto the same lateral side of the cylinder-head.

According to other features:

- the exhaust pipe opens onto said lateral side at a level between that of the inlet pipes and that of the surface of the cylinder-head in contact with the cylinder block;
- the mean lines of the exhaust and inlet pipes are contained in planes perpendicular to the longitudinal plane;
- the cylinder-head unit is provided with an overhead cam shaft disposed at equal distances from the axes of the exhaust and inlet valves, all the valves being actuated by identical followers.

BRIEF DESCRIPTION OF THE DRAWINGS

One embodiment of the invention will now be described with reference to the accompanying drawings, in which.

DETAILED DESCRIPTION

Figure 2:
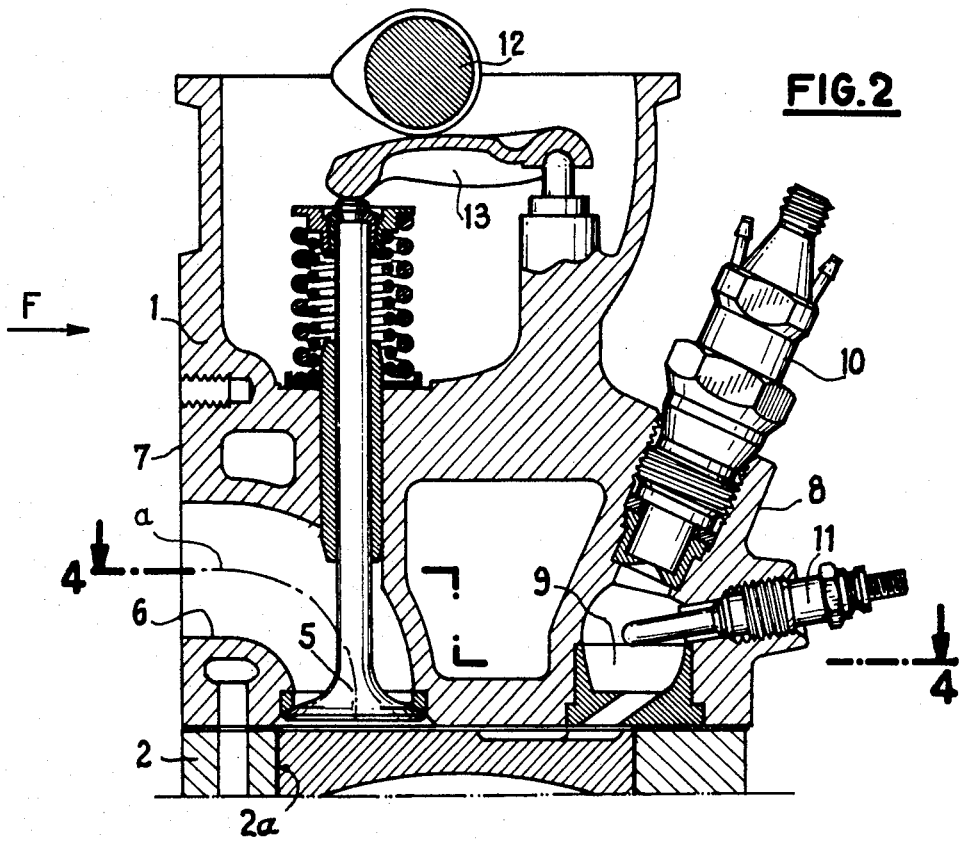
FIG. 2 is a sectional view taken along line 2—2 of FIG. 1.
Figure 1:
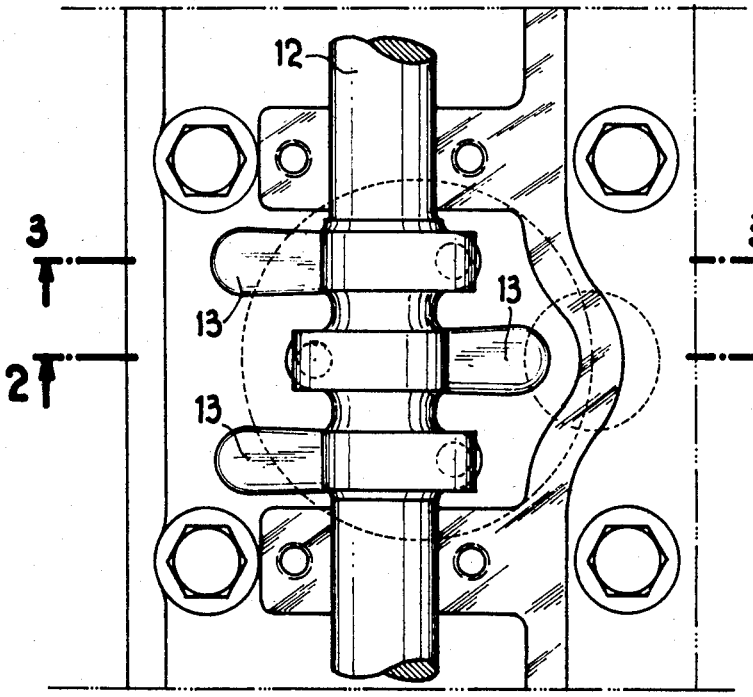
FIG. 1 is a plan view of a part of a cylinder-head unit according to the invention.
Figure 3:
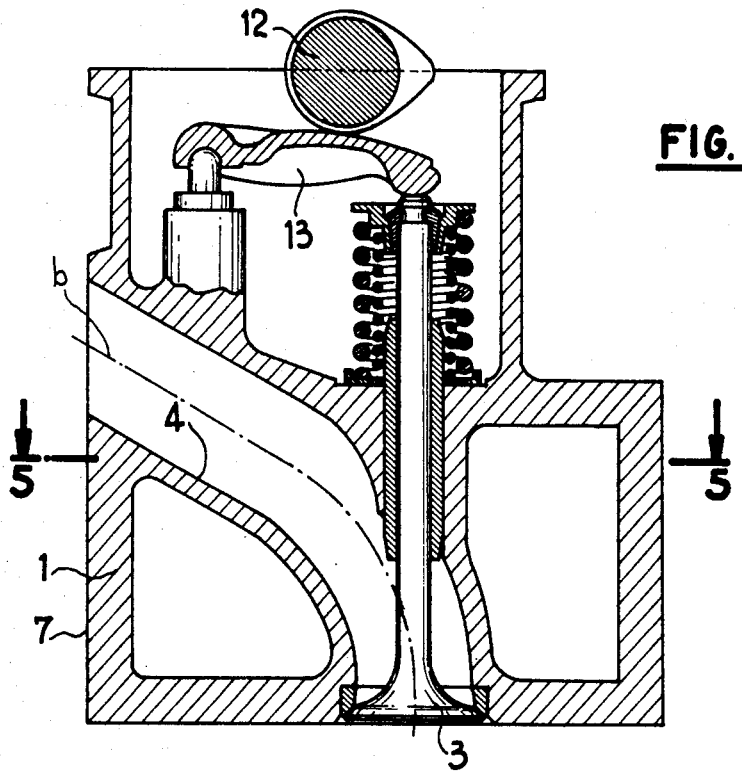
FIG. 3 is a sectional view taken along line 3—3 of FIG. 1.
Figure 4:
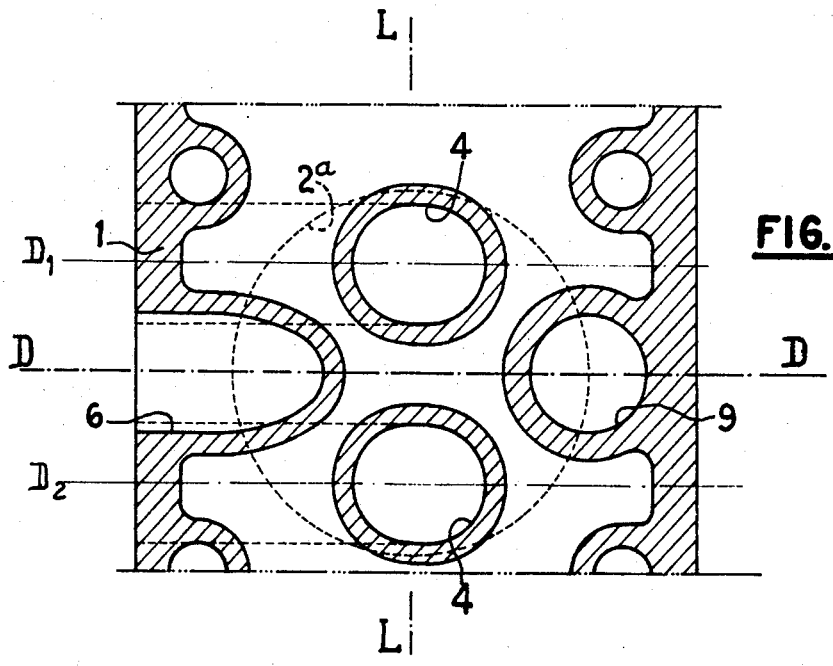
FIG. 4 is a sectional view taken along line 4—4 of FIG. 2.
Figure 5:
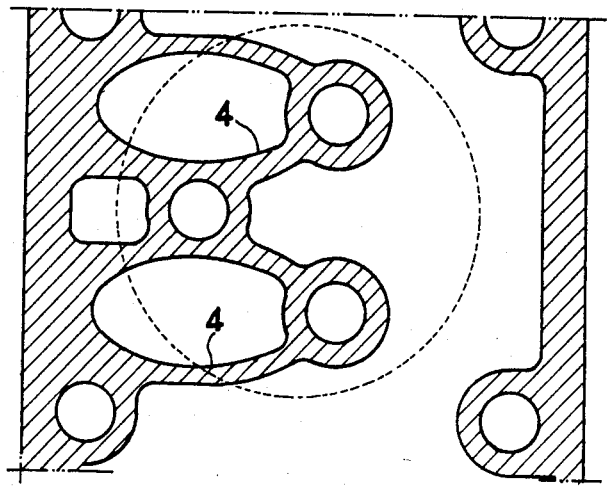
FIG. 5 is a sectional view taken along line 5—5 of FIG. 3.
Figure 6:
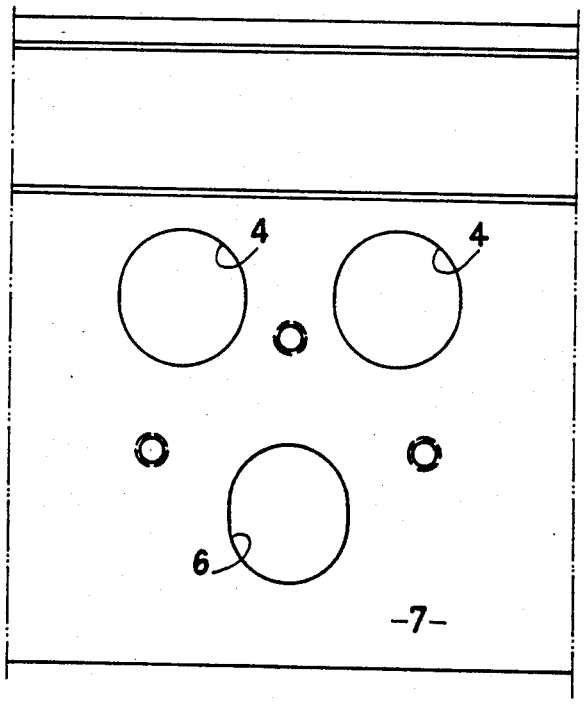
FIG. 6 is a view in the direction of the arrow F of FIG. 2.

The Figures show a part of a cylinder-head 1 of a cylinder head unit of an internal combustion engine ignited by compression. This engine comprises a block 2 defining a plurality of cylinders, such as 2*a*, whose axes are contained in a longitudinal plane L (FIG. 4). In respect of each cylinder, two inlet valves 3 each cooperate with an inlet pipe 4 and an exhaust valve 5 cooperates with an exhaust pipe 6.

The inlet valves 3 and the exhaust valve 5 have their axes parallel to the axis of the cylinder 2*a*. The exhaust pipe 6 has a curved mean line a contained in a diametrical plane D of the cylinder 2 perpendicular to the longitudinal plane L. The mean lines b of the inlet pipes 4 are also curved and symmetrical to each other relative to the diametrical plane D. These mean lines are therefore also contained in planes perpendicular to the plane L. The inlet pipes 4 and the exhaust pipe 6 open onto the same lateral side 7 of the cylinder-head, the exhaust pipe 6 opening onto this lateral side at a level between the level of the inlet pipes 4 and the level of the surface of the cylinder-head in contact with the cylinder-block 2.

Owing to this arrangement, the other lateral side 8 of the cylinder-head is perfectly free and this allows complete latitude as concerns the placement of a precombustion chamber 9 with an injector 10 and a preheating spark-plug 11. It is in particular possible to give the injector 10 the orientation of the precombustion chamber 9 the shapes which have been optimized on an engine having two valves per cylinder.

Further, this arrangement permits the construction of a particularly simply and compact timing gear with a single overhead cam-shaft 12 disposed at equal distances from the axes of the exhaust and inlet valves, all the valves being actuated by identical followers 13.

We claim:

1. A cylinder-head unit for an internal combustion engine cylinder block having a plurality of cylinders having axes which are contained in a longitudinal plane, the cylinder-head unit comprising a cylinder-head having a lateral side and a lower surface for fixing to the cylinder block, two inlet valves and an exhaust valve for each cylinder, inlet pipes combined with respective inlet valves, and an exhaust pipe combined with the exhaust valve and having a mean line in a diametrical plane of the respective cylinder, which diametrical plane is substantially perpendicular to said longitudinal plane, the inlet pipes being disposed symmetrically with each other relative to said diametrical plane, the inlet pipes opening onto said lateral side of the cylinder-head along a common level and the exhaust pipe opening onto said lateral side at a level below the level of the inlet pipes and above said lower surface of the cylinder-head, said cylinder-head unit further comprising a single overhead camshaft disposed at equal distances from planes parallel to said longitudinal plane and containing said inlet valves and said exhaust valve, and identical followers cooperative with said cam-shaft for actuating all the valves.

2. A cylinder-head according to claim 1, wherein mean lines of the exhaust pipe and inlet pipes are contained in planes substantially perpendicular to the longitudinal plane.

3. A cylinder-head unit for an internal combustion engine cylinder block having a plurality of cylinders having axes which are contained in a longitudinal plane, the cylinder-head unit comprising a cylinder-head having a lateral side and a lower surface for fixing to the cylinder block, two inlet valves and an exhaust valve for each cylinder, inlet pipes combined with respective inlet valves, and an exhaust pipe combined with the exhaust valve and having a mean line in a diametrical plane of the respective cylinder, which diametrical plane is substantially perpendicular to said longitudinal plane, the inlet pipes being disposed symmetrically with each other relative to said diametrical plane, the inlet pipes opening onto said lateral side of the cylinder-head along a common level and the exhaust pipe opening onto said lateral side at a level below the level of the inlet pipes and above said lower surface of the cylinder-head, said cylinder-head unit further comprising a single overhead cam-shaft disposed at equal distances from planes parallel to said longitudinal plane containing said inlet valves and said exhaust valve, identical followers cooperative with said camshaft for actuating all the valves, and a precombustion chamber for each cylinder disposed adjacent to a second lateral side of the cylinder-head opposed to the first mentioned lateral side.

* * * * *